US008608756B2

(12) United States Patent
Oberman

(10) Patent No.: US 8,608,756 B2
(45) Date of Patent: Dec. 17, 2013

(54) DISC FOR AN EPILATING APPARATUS DISC ASSEMBLY

(75) Inventor: Wolfgang Oberman, Klagenfurt (AT)

(73) Assignee: Koninklijke Philips N.V., Eindhoven (NL)

( * ) Notice: Subject to any disclaimer, the term of this patent is extended or adjusted under 35 U.S.C. 154(b) by 711 days.

(21) Appl. No.: 11/912,914

(22) PCT Filed: May 2, 2006

(86) PCT No.: PCT/IB2006/051371
§ 371 (c)(1),
(2), (4) Date: Oct. 29, 2007

(87) PCT Pub. No.: WO2006/117755
PCT Pub. Date: Nov. 9, 2006

(65) Prior Publication Data

US 2008/0200929 A1 Aug. 21, 2008

(30) Foreign Application Priority Data

May 2, 2005 (EP) ..... 05103636

(51) Int. Cl.
*A61B 17/50* (2006.01)

(52) U.S. Cl.
USPC ..... 606/133

(58) Field of Classification Search
USPC ..... 452/71, 82–88, 99–102; 606/131, 133, 606/210
See application file for complete search history.

(56) References Cited

U.S. PATENT DOCUMENTS

| | | | | | |
|---|---|---|---|---|---|
| 4,174,713 | A | * | 11/1979 | Mehl | 606/42 |
| 4,613,326 | A | * | 9/1986 | Szwarc | 604/89 |
| 5,032,126 | A | | 7/1991 | Cleyet | |
| 5,462,557 | A | | 10/1995 | Jordan | |
| 5,976,157 | A | * | 11/1999 | Yiu | 606/133 |
| 6,824,461 | B1 | * | 11/2004 | Dolev | 452/83 |

FOREIGN PATENT DOCUMENTS

| | | | |
|---|---|---|---|
| EP | 0383719 | A2 | 8/1990 |
| EP | 1256287 | A2 | 11/2002 |
| WO | 0132048 | | 5/2001 |

* cited by examiner

*Primary Examiner* — Ryan Severson
*Assistant Examiner* — Ashley Fishback

(57) ABSTRACT

A disc for an epilating apparatus disc assembly includes at least one clamping portion intended to interact with a further clamping portion of a neighboring disc when the disc and the epilating apparatus are arranged as the epilating apparatus-disc assembly, with a radially outward region of the clamping portion. The radially outward region and a radially inward region are harder than a radially intermediate region of the clamping portion.

14 Claims, 5 Drawing Sheets

DISC FOR AN EPILATING APPARATUS DISC ASSEMBLY

The present invention relates to a disc for an epilating apparatus disc assembly, the disc comprising at least one clamping portion intended to interact with a further clamping portion of a neighboring disc when the disc and the epilating apparatus are arranged as the epilating apparatus-disc assembly.

The invention further relates to a disc assembly comprising at least one disc according to the invention.

The invention further relates to an epilating apparatus comprising at least one disc assembly according to the invention.

Furthermore, the invention relates to a method for making a disc for an epilating apparatus disc assembly.

Discs of the type mentioned above are for example known from WO 01/32048 A1, which hereby is incorporated by reference. The discs known from WO 01/32048 A1 are made from a synthetic material. To provide sufficient hair grip and to prevent embedment of hair, it is necessary that the synthetic material comprises a high surface stiffness and a high e-modulus, i.e. a relatively hard synthetic material is necessary. A disadvantage in connection with such hard materials is that wear becomes a problem in areas where parts are moving relative to each other. This leads to a loss of accuracy in the system and to a rise in power consumption.

It is an object of the invention to further develop the discs of the type mentioned in the opening paragraph, such that sufficient hair grip is provided and wear is reduced, and a further object of the invention is to provide a method that is suitable for manufacturing such discs.

This object is achieved by the features of the independent claims. Further developments and preferred embodiments of the invention are outlined in the dependent claims.

In accordance with a first aspect of the invention, there is provided a disc for an epilating apparatus disc assembly, wherein the disc comprises at least one clamping portion intended to interact with a further clamping portion of a neighboring disc when the disc and the epilating apparatus are arranged as the epilating apparatus-disc assembly, and a radially outward region of the clamping portion is harder than a radially inward region of the clamping portion. The term "clamping portion" denotes those portions of the disc that are periodically in contact with a clamping portion of a neighboring disc during operation of the epilating apparatus in order to clamp a hair. The clamping portions are partially made from a relatively hard material, in particular the radially outward or circumferential parts of the clamping portions, and partially from a relatively soft material, in particular the radially inward parts. These softer parts can be denoted as "gliding surface" of the clamping portion. The clamping portions' shape and dimension as such can for example be as described in WO 01/32048 A1. The hardness of the circumferential region of the clamping portion is necessary since this region mainly has to provide the pinching or clamping force. Other regions of the clamping portion, especially areas where the clamping portions of neighboring discs are moving relative to each other, are more susceptible to wear and are made of a material comprising good gliding properties. In this way wear of the clamping portion can be reduced significantly such that the system accuracy is maintained and a rise in power consumption is prevented.

Furthermore, it is preferred that the disc in accordance with the invention comprises pivot motion delaying means, wherein the radially outward region of the clamping portion is harder than at least a part of the pivot motion delaying means. The pivot motion delaying means can for example be formed by a stepwise configuration of the upper and lower surfaces of the disc, as is also described in detail in WO 01/32048 A1. It is advantageous to provide such pivot motion delaying means to ensure that the pinching elements of two adjacent discs reach the pinching position simultaneously although there is provided a necessary clearance between a shaft supporting the discs and disc bearings interacting with the shaft.

In accordance with a further development of the disc in accordance with the invention, the disc comprises torque transmitting means for transmitting a torque from/to a neighboring disc and/or from a drive, wherein the radially outward region of the clamping portion is harder than at least a part of the torque transmitting means. The torque transmitting means can, for example, be formed by recesses and projections provided on the disc surfaces and intended to engage with corresponding counterparts of the neighboring disc(s).

It is also preferred that the disc in accordance with the invention comprises a bearing region, wherein the radially outward region of the clamping portion is harder than at least a part of the bearing region. The bearing region can for example be formed by a central bore intended to interact with a shaft of an epilating apparatus. The diameter of such a bore is preferably slightly larger than the diameter of the shaft to enable the necessary pivot motion of the disc.

In connection with a special embodiment of the disc in accordance with the invention, the disc is intended to be an end disc of a disc assembly, wherein the end disc comprises side bearing means, and wherein the radially outward region of the clamping portion is harder than at least a part of the side bearing means. While it is preferred that the discs between the two end discs of a disc assembly are identical, it will be necessary at least in some cases that at least one end disc comprises a different configuration.

In highly preferred embodiments of the invention, the disc is made by a 2K molding process. With the 2K molding technology it is possible to make one-piece components comprising regions with different material properties and/or regions made of different materials. The 2K molding technology as such is well known to the person skilled in the art and will therefore not be described herein.

According to a preferred embodiment, the disc is a molded or cast part. This leads to a reduction of the production costs compared to, for example, known metal discs made on the basis of a punching process and further processing steps. For molding or casting the disc, for example, the following technologies can be used: plastic injection molding, metal injection molding and/or zinc (pressure) casting. Highly preferred are 2K technologies as will be discussed in detail below.

Especially in connection with the 2K molding technology, it is preferred that harder regions of the disc are made of a first material and softer regions of the disc are made of a second material. Although, in view of the production costs, it is preferred that only two different materials are used, the invention is not limited to such solutions and it is also possible to use more than two materials or to provide more than two different material properties for the disc.

In a further highly preferred embodiment of the disc in accordance with the invention, harder regions of the disc are made of a first material comprising a first color and softer regions of the disc are made of a second material comprising a second color. In epilating apparatus application tests it has been recognized that it is sometimes difficult to catch single hairs if the tweezers of the discs do not differ optically from their surroundings. Colored tweezers can be seen during the epilation process, and this makes it easier to catch single hairs. The 2K molding technology mentioned above is very suitable to make such discs comprising at least two different colors.

As regards suitable materials for making the disc in accordance with the invention, it is for example possible that harder regions of the disc are made of a first material and softer regions of the disc are made of a second material, wherein the first material is a material filled with a hard component and the second material is a material filled with a gliding supporter. The material filled with a hard component can for example be a glass-filled plastic, for example Grivory GV 6H (60% GF)+10% zirconium oxide, and the material filled with a gliding supporter can for example be a PA/PTFE mixture, for example polyamide PA6.6+PTFE. Besides glass, it is, for example, also possible to fill the plastic with $TiO_2$, ZiO, $Al_2O_3$, or suitable carbon fibers. Besides PTFE, it is, for example, also possible to use silicone. For example, POM could be used instead of PA. Although the above materials are preferred, the invention is not limited to these materials, i.e. any material(s) or material mixtures suitable for molding and/or casting can be used. Since the harder material will in many cases be more expensive than the softer material, the use of two different materials not only leads to reduced wear but also to reduced material costs. Furthermore, it is preferred that at least the second material is a sound-damping material to minimize sound generation during operation of the epilating apparatus.

At least for some embodiments of the disc in accordance with the invention, it is preferred that the disc comprises at least one tweezer intended to interact with a further tweezer of a neighboring disc, and that the tweezer is at least partly structured and/or coated by a coating material. Structuring and/or coating particularly the active surface of the tweezer can contribute to further reduce wear. The structuring and/or coating, for example by a suitable lacquer or plastic layer, is preferably performed such that, on the one hand, sufficient grip is provided to perform the pinching function and, on the other hand, friction and therefore wear is reduced. Without being limited thereto, it is particularly preferred to structure and/or coat the surface of tweezers that are made of a metal.

Every disc assembly for an epilating apparatus and every epilating apparatus comprising at least one disc in accordance with the invention is covered by the scope of the accompanying claims.

In accordance with a second aspect of the present invention, there is provided a method of manufacturing a disc for an epilating apparatus-disc assembly, wherein a 2K molding process is performed to manufacture the disc such that a radially outward region of at least one clamping portion intended to interact with a further clamping portion of a neighboring disc, when the disc and the epilating apparatus are arranged as the epilating apparatus-disc assembly, is harder than a radially inward region of the clamping portion. As mentioned above, the 2K molding technology is very suitable to manufacture the discs in accordance with the invention.

From the above description it should be clear that it is a basic idea of the invention to use a hard material providing sufficient hair grip for at least a part of the pinching regions of the disc and a softer material leading to reduced wear for the remaining disc regions.

The above and further aspects and advantages of the invention will be apparent from and elucidated with reference to the embodiments described hereinafter and shown in the drawings, wherein FIG. 1 shows a top view of the upper side of a disc in accordance with the invention;

Figure 10:
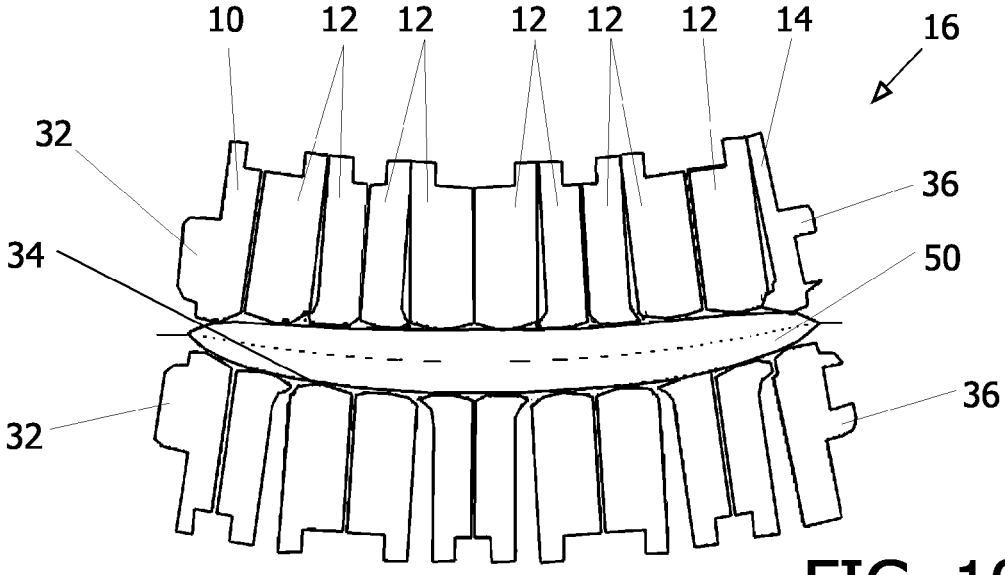
Figure 11:
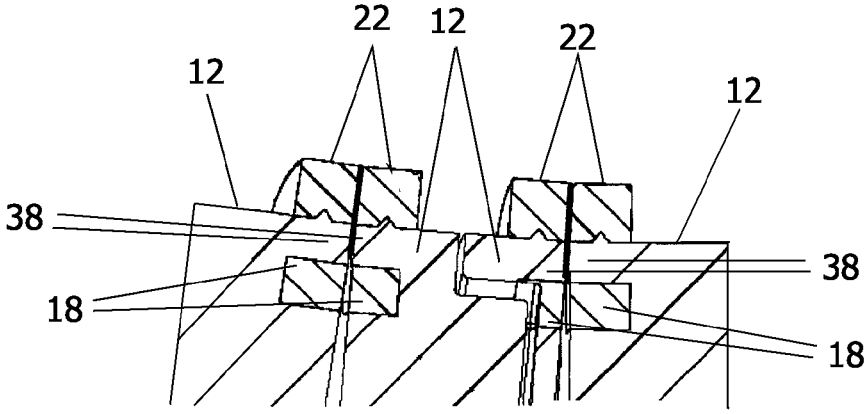
Figure 12:
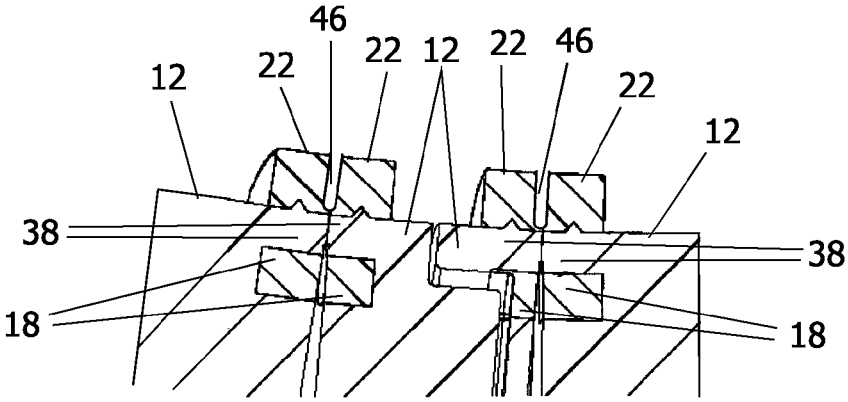
Figure 13:
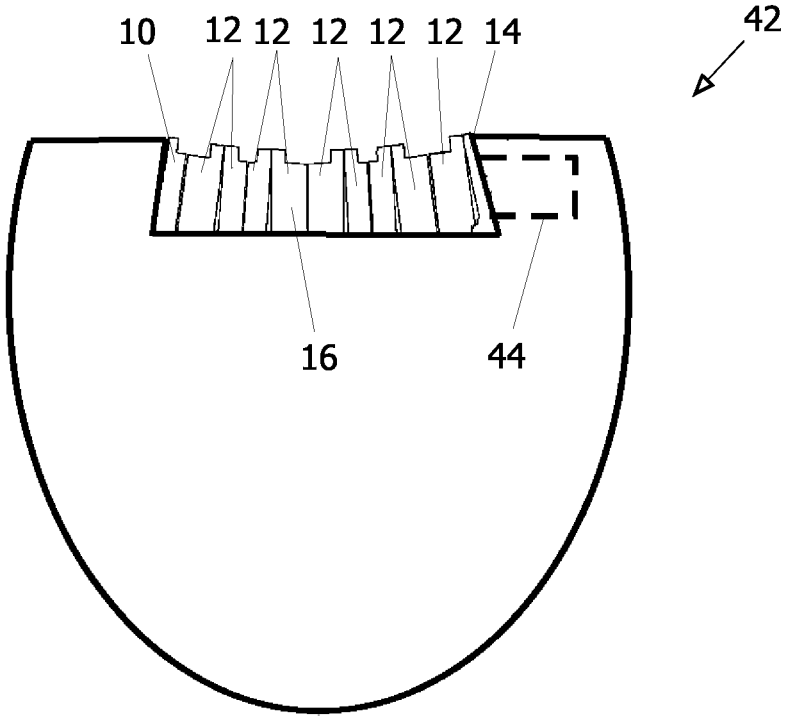

FIG. 10 schematically shows a sectional view of a disc assembly comprising discs in accordance with the invention;

FIG. 11 shows a sectional detailed view of four adjacent discs of the disc assembly of FIG. 10, FIG. 12 shows the discs of FIG. 11 after prolonged use; and FIG. 13 schematically shows an epilating apparatus using the disc assembly of FIG. 10.

Since FIGS. 1 to 9 show different views of the same disc, these Figures will be referenced simultaneously.

The disc 12 shown in FIGS. 1 to 9 has a substantially circular shape. Circumferential regions 18, 20 of the disc 12 are made from a relative hard material, for example a glass-filled plastic like Grivory GV 6H (60% GF)+10% zirconium oxide. The other regions 24-40, which will be explained in greater detail below, are made from a softer material having good gliding properties like polyamide PA6.6+PTFE.

The circumferential region 18 is a part of a clamping portion intended to interact with further clamping portions of a neighboring disc, as is well known to the person skilled in the art. In the sense of the present disclosure, the circumferential region 18 is called a tweezer, while two abutting circumferential regions form tweezers.

The softer regions 24-30 of the disc 12 comprise pivot motion delaying means which are formed by two steps 24 provided on the upper side of the disc and two steps 26 provided on the lower side of the disc. The stepwise configuration of the disc surfaces ensures that the tweezers or pinching elements of neighboring discs in a disc assembly are synchronized as described in detail in WO 01/32048 A1, which has been incorporated herein by reference.

Furthermore, the disc 12 comprises torque transmitting means 28 and 30 for transmitting a torque from/to a neighboring disc in a disc assembly. The torque transmitting means are formed by projections 28 and recesses 30, wherein the projections 28 are configured such that they can engage in recesses 30 of a neighboring disc to receive/transmit the torque. Since the torque transmitting means 28, 30 are susceptible to wear, it is very advantageous that these means are made from the second, softer material having good gliding properties.

The same applies to a bearing region 34 in the form of a center bore which is intended to interact with a shaft of an epilating apparatus, as will be described in connection with FIG. 10 below.

Figure 1:
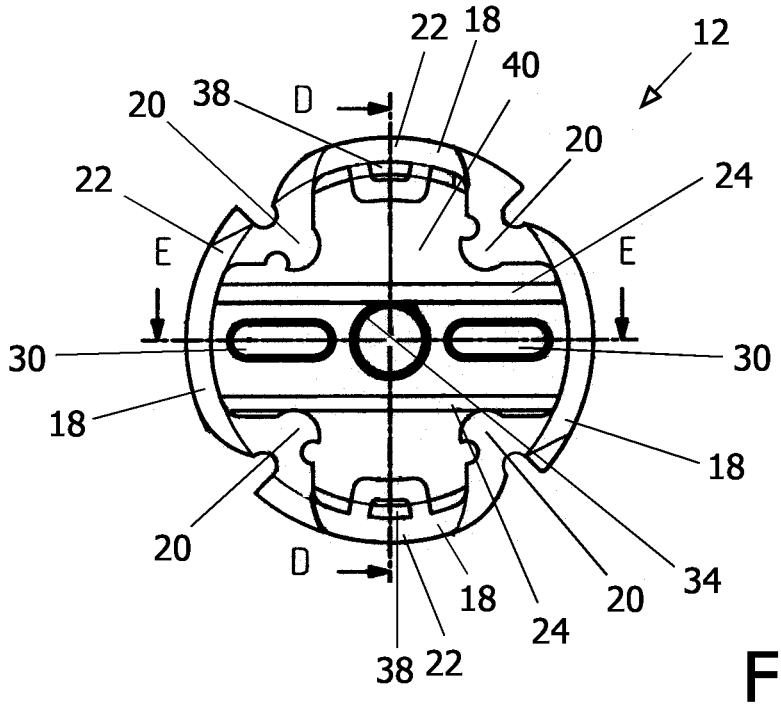
Figure 2:
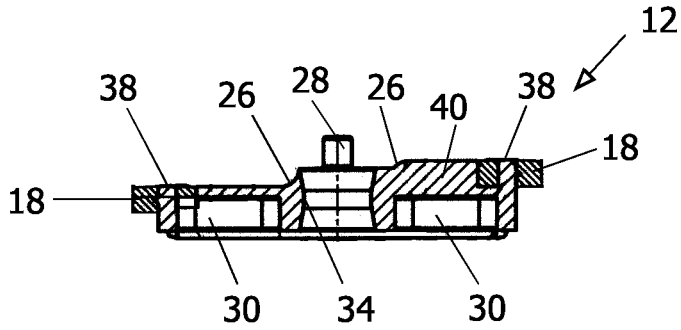
FIG. 2 shows a sectional view along the intersection line E-E of FIG. 1.
Figure 3:
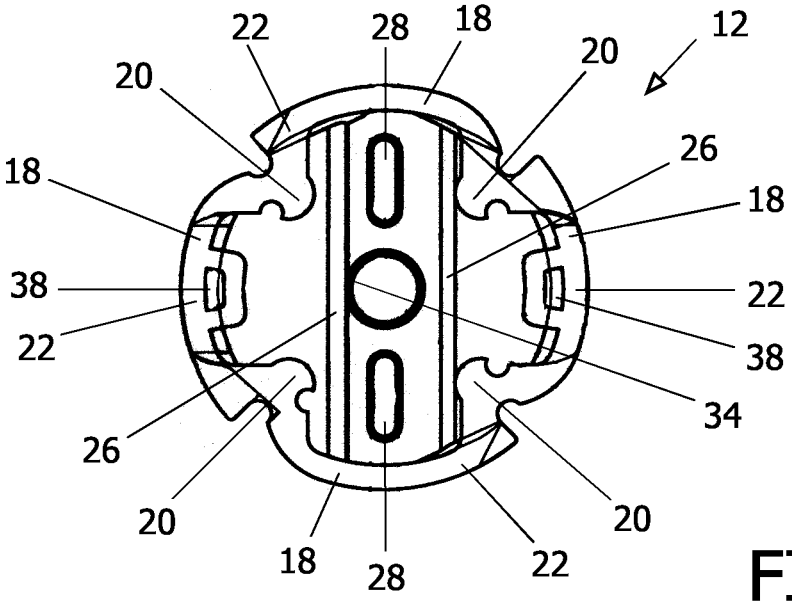
FIG. 3 shows a top view of the lower side of the disc of FIG. 1.
Figure 4:
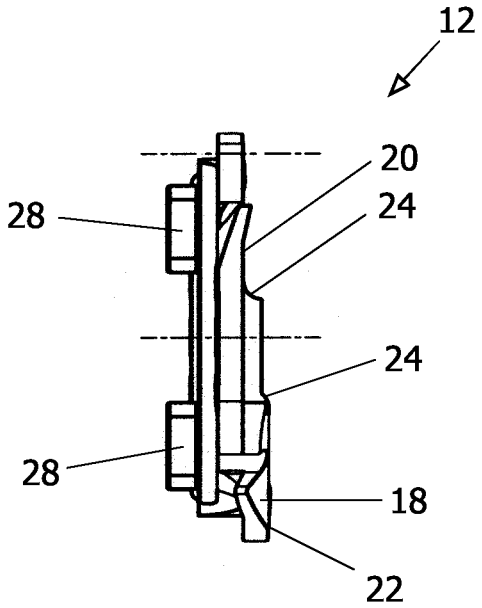
FIG. 4 shows a side view of the disc of FIG. 1.
Figure 5:
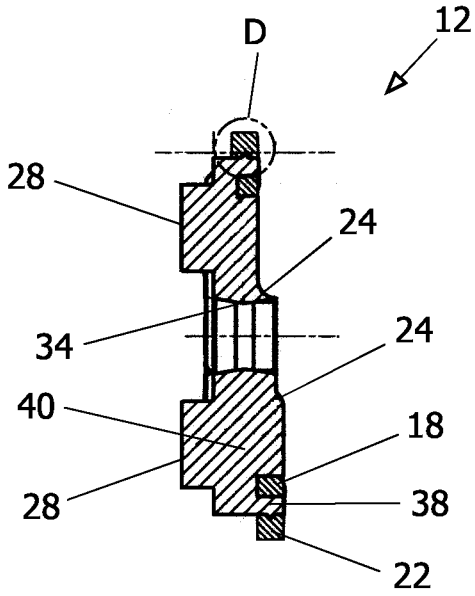
FIG. 5 shows a sectional view along the intersection line D-D of FIG. 1.
Figure 7:
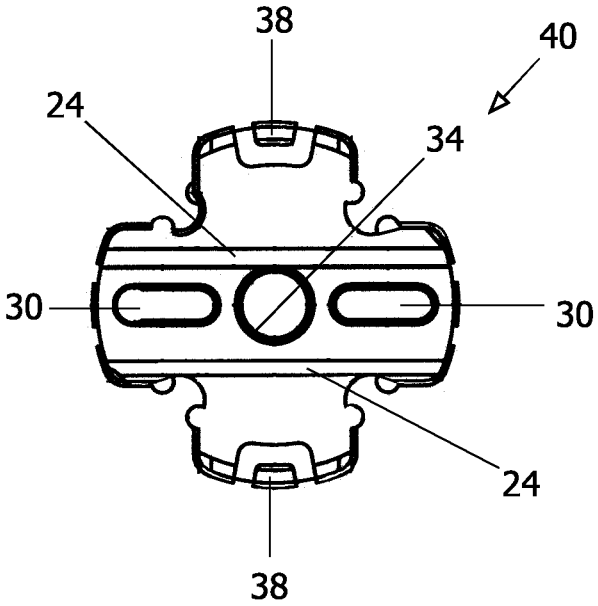
FIG. 7 shows only the softer region of the disc of FIG. 1.

The disc 12 is made by a 2K molding process, which as such is well known to the person skilled in the art. To support the connection between the two materials used for the regions 18, 20 and 24-30 there are provided means for enhancing a form fit between the different regions. These means are exemplarily illustrated as projections 38 that are best seen in FIG. 7. These projections 38 can also serve as a part of the contact or pinching surface as discussed below.

Figure 6:
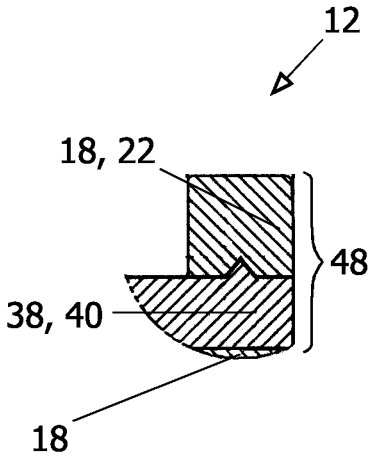
FIG. 6 shows the detail D of FIG. 5.
Figure 8:
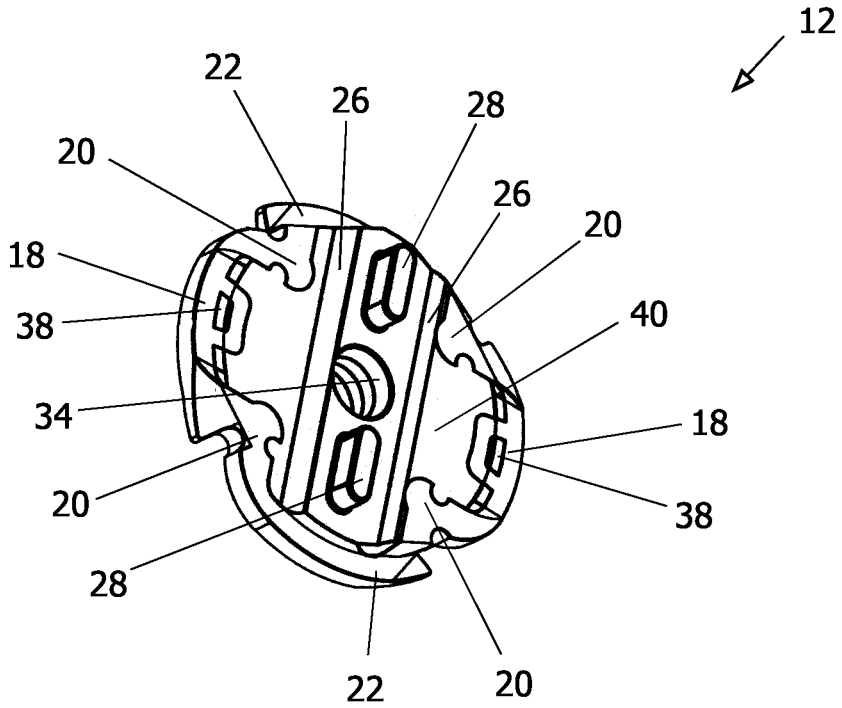
FIG. 8 shows a perspective view of the lower side of the disc of FIG. 1.
Figure 9:
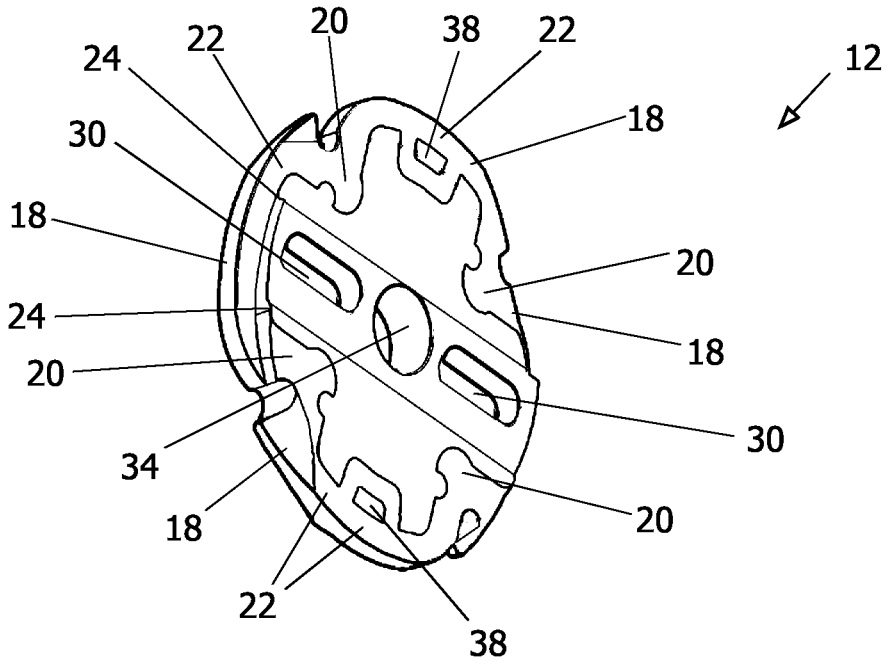
FIG. 9 shows a perspective view of the upper side of the disc of FIG. 1.

The detailed view of FIG. 6 illustrates that the contact or pinching surface 48 consists of two halves. One half is formed by the tweezer 22, which is made of the hard material. The other half is formed by the projection 38, which is made of the softer material.

FIG. 10 schematically shows a sectional view of a disc assembly comprising discs in accordance with the invention. The illustrated disc assembly 16 consists of nine discs 12 as described with reference to FIGS. 1 to 9. The nine discs 12 are arranged between two end discs 10 and 14. The end disc 14 comprises side bearing means 36 which are intended to interact with bearing means of an epilating apparatus (not shown). The end disc 10 comprises torque transmitting means 32 which are intended to receive a torque created by the drive of an epilating apparatus. From FIG. 10 it may also be seen that the center bores of the discs 10, 12, 14 have a diameter which is slightly larger than the diameter of a shaft 50 on which the discs are arranged. This is necessary to enable the necessary pivot motion when the epilating apparatus is in operation.

FIG. 11 shows a sectional detailed view of four adjacent discs of the disc assembly of FIG. 10. From FIG. 11 it may be clearly seen how the contact or pinching surfaces 48 (FIG. 6) of adjacent discs 12 interact. As shown in FIG. 6 the pointed projection 38 has a triangular cross section, the recess that receives the pointed projection 38 is located radially into the tweezer portion 22 and radially away from the center of the disc 12, and the pointed projection 38 projects radially into the recess. Since the projections 38 are made of the softer material, the contact surfaces of the tweezers are prevented from unacceptable wear. The friction between parts made of the harder material is reduced compared to discs that are completely made of hard material. As may be seen, there is still friction between the tweezers 22 made of the harder material. This friction leads to wear, as illustrated in FIG. 12, which shows the discs of FIG. 11 after prolonged use. The wear 46 can not be completely prevented, but this wear 46 of the hard material 18 on the contact surface is smaller than the diameter of a hair. Therefore, the wear 46 does not lead to a malfunction of the epilating apparatus.

FIG. 13 schematically shows an epilating apparatus using the disc assembly of FIG. 10. The epilating apparatus 42 comprises an epilation opening which enables contact between the disc assembly 16 and the skin to be treated. The discs 10, 12, 14 of the disc assembly 16 are rotated via a drive 44 provided within the epilating apparatus 42. Equivalents and modifications not described above may also be employed without departing from the scope of the invention, which is defined in the accompanying claims.

The invention claimed is:

1. A disc for an epilating apparatus-disc assembly, the disc comprising at least one clamping portion intended to clamp a hair when interacting with a further clamping portion of a neighboring disc when the disc, and the neighboring disc are arranged as the epilating apparatus-disc assembly, wherein the at least one clamping portion includes a contact surface for contacting the hair, the contact surface comprising two portions, a first portion projecting radially further from a second portion, wherein the first portion is harder than the second portion, and wherein the first portion includes a recess for receiving a pointed projection of the second portion and maintaining the pointed projection in the recess during operation for enhancing a form fit between the first portion and the second portion, the pointed projection having a triangular cross section, and wherein the recess is located radially into the first portion and radially away from a center of the disc and wherein the pointed projection of the second portion projects radially into the recess.

2. The disc according to claim 1, further comprising a first set of two steps on a first side of the disc and a second set of two steps on a second side of the disc opposite the first side, and wherein the first portion is harder than at least a part of the first set and the second set of two steps.

3. The disc according to claim 1, further comprising two projections configured to transmit a torque from/to a neighboring disc and/or from a drive, and wherein the first portion is harder than at least a part of the two projections, wherein the two projections project away from a side of the disc and have walls that define recesses for receiving further two projections of an adjacent disc, and wherein the disc has a center bore configured to receive a shaft for driving the disc, the center bore and the two projections being aligned symmetrically along a radial axis of the disc.

4. The disc according to claim 1, further comprising a bearing region, and wherein the first portion is harder than at least a part of the bearing region.

5. The disc according to claim 1, wherein the disc is intended to be an end disc of a disc assembly, wherein the end disc comprises a side projection that projects in a direction perpendicular to the pointed projection, and wherein the first portion is harder than at least a part of the side pointed projection.

6. The disc according to claim 1, wherein the disc is made by a 2K molding process.

7. The disc according to claim 1, wherein the disc is a molded or cast part.

8. The disc according to claim 1, wherein harder regions of the disc are made of a first material and softer regions of the disc are made of a second material.

9. The disc according to claim 1, wherein harder regions of the disc are made of a first material having a first color and softer regions of the disc are made of a second material having a second color.

10. The disc according to claim 1, wherein harder regions of the disc are made of a first material and softer regions of the disc are made of a second material, and wherein the first material is filled with a hard component and the second material is filled with a gliding supporter.

11. The disc according to claim 1, wherein the disc comprises at least one tweezer intended to interact with a further tweezer of a neighboring disc, and wherein the tweezer is at least partly structured and/or coated by a coating material.

12. A disc assembly for an epilating apparatus comprising at least one disc according to claim 1.

13. An epilating apparatus comprising at least one disc assembly according to claim 12.

14. A method of manufacturing a disc for an epilating apparatus-disc assembly intended to clamp a hair when the disc interacts with a neighboring disc when the disc and the neighboring disc are arranged as the epilating apparatus-disc assembly, comprising the acts of:

performing a 2K molding process to manufacture the disc; and forming at least one clamping portion intended to interact with a further clamping portion of a neighboring disc, when the disc and the epilating apparatus are arranged as the epilating apparatus-disc assembly, wherein the at least one clamping portion includes a contact surface for contacting the hair, the contact surface comprising two portions, a first portion projecting radially further from a second portion, wherein the first portion is harder than the second portion, and wherein the first portion includes a recess for receiving a pointed projection of the second portion and maintaining the pointed projection in the recess during operation for enhancing a form fit between the first portion and the second portion, the pointed projection having a triangular cross section, and wherein the recess is located radially into the first portion and radially away from a center of the disc and wherein the pointed projection of the second portion projects radially into the recess.

* * * * *